US006286168B1

(12) United States Patent
Woodruff et al.

(10) Patent No.: US 6,286,168 B1
(45) Date of Patent: Sep. 11, 2001

(54) BICYCLE REPAIR TOOL

(75) Inventors: Wendell J. Woodruff, Walled Lake, MI (US); Luke W. Michas, North Providence; Jeremy Howard, Little Compton, both of RI (US); Bruce P. Fina, Andover, MA (US)

(73) Assignee: Pedro's USA, Wilmington, MA (US)

( * ) Notice: Subject to any disclaimer, the term of this patent is extended or adjusted under 35 U.S.C. 154(b) by 0 days.

(21) Appl. No.: 09/659,480

(22) Filed: Sep. 11, 2000

(51) Int. Cl.[7] ..... B25B 13/00
(52) U.S. Cl. ..... 7/138; 7/168; 81/440
(58) Field of Search ..... 7/138, 100, 165, 7/167, 170; 81/440, 437; 59/7; 29/243.54

(56) References Cited

U.S. PATENT DOCUMENTS

| | | | | |
|---|---|---|---|---|
| 2,804,970 | * | 9/1957 | Kuc et al. | 7/138 |
| 5,140,736 | | 8/1992 | Hsiao . | |
| 5,146,815 | * | 9/1992 | Scott, III | 81/437 |
| 5,450,774 | * | 9/1995 | Chang | 7/168 |
| 5,655,242 | * | 8/1997 | Chuang | 7/100 |
| 5,711,042 | | 1/1998 | Chuang . | |
| 5,791,211 | | 8/1998 | Bondhus et al. . | |
| 6,092,444 | * | 7/2000 | Hsiao | 81/440 |
| 6,112,351 | | 9/2000 | Hawkins et al. . | |
| 6,128,981 | * | 10/2000 | Bondhus et al. | 81/440 |
| 6,151,999 | * | 11/2000 | Eklind | 7/138 |

* cited by examiner

*Primary Examiner*—James G. Smith
*Assistant Examiner*—Hadi Shakeri
(74) *Attorney, Agent, or Firm*—Baker & Daniels

(57) ABSTRACT

A bicycle repair tool includes a handle and a plurality of repair tools pivotably mounted at one end of the handle. A planar bridge connects the left and right side walls of the handle and serves as a rest surface for the repair tools in their undeployed position. The repair tool further includes a chain tool mounted within the handle and slidably supported at an opposite end thereof. The handle defines an elongated slot at the opposite end sized to slidably receive the threaded collar of the chain tool. The handle of the chain tool defines an opening and the planar bridge defines a correspondingly configured raised boss to hold the chain tool within the repair tool handle when the chain tool handle is in contact with the planar bridge. The raised boss can include a sloped surface to facilitate sliding the chain tool out of the repair tool handle. The chain tool includes a pressure screw having an internal hex head configured to be driven by one of the repair tools.

9 Claims, 5 Drawing Sheets

BICYCLE REPAIR TOOL

BACKGROUND OF THE INVENTION

The present invention relates to a combination tool, specifically for use in the maintenance and repair of bicycle components. More particularly, the invention concerns a combination tool that incorporates a chain repair tool The latter half of the twentieth century saw an increase in bicycling as a recreational endeavor and a sport. The early single speed bicycle has spawned a wide range of special purpose bicycles, such as road bikes, mountain bikes, and hybrids. Moreover, science and technology has been applied to the design of bicycles to increase speed and comfort and durability.

In spite of the technological advances in bicycle design (or perhaps because of it), bicyclists have been plagued with the problem of minor breakdowns of the bicycle components. Murphy's Law of bicycling means that these breakdowns usually occur far from help or access to repair equipment.

In response to this overwhelming need, a number of combination repair tools have been developed that are small and lightweight. These combination tools include specific tools for repairing most minor bicycle problems. For example, the typical combination bicycle repair tool includes a number of hex wrenches, a spoke tightening wrench and tire pry levers. In some cases, these tools are provided as part of a tool kit, such as the "Power 21" kit sold by Topeak. Another genre of bicycle repair tools is represented by the Blackburn "MT15M" which includes a number of tools removably supported on a carrier body.

Perhaps the most popular type of combination tool is the folding hand tool set. With this type of product, a number of bicycle tools are rotably mounted to a handle. The tools can be pivoted outward to a working position. There are countless folding hand tool products on the market today.

One problem, however, with all of the prior combination bicycle repair tools has been in connection with a chain tool. A typical stand-alone chain tool is represented in U.S. Pat. No. 5,140,736. This chain tool includes a body for supporting a link of a chain. The body also supports a rivet removal tool, which is typically a pressure screw or a "tommy" screw. As depicted in the '736 patent, the bicycle chain tool includes a handle for leveraged rotation of the "tommy" screw, and a separate handle for supporting the housing and reacting the force of rotating the pressure screw into engagement with the chain rivet.

Of course, the chain tool shown in the '736 patent is not particularly compact or easy to carry in a bicycle pouch. A chain tool has been incorporated into a few hand-held folding tools, as represented by the combination tools shown in U.S. Pat. Nos. 5,711,042 and 6,112,351. One primary difficulty with these two combination tools is that the chain tool is integrated into the tool assembly—i.e., it must be pivoted outward from the housing into its usable position. While providing the chain tool with the compact hand tool presents advantages over the stand-alone chain tools, these two devices are very cumbersome to use. In both cases, the chain tool remains connected to the housing or handle of the tool.

Consequently, there is a need for a combination bicycle repair tool that retains the compactness of the folding tool set. At the same time, the new tool must have the capability of supporting a bicycle chain repair tool that is easily accessed and is not cumbersome to use.

SUMMARY OF THE INVENTION

To address these needs, the present invention provides a combination bicycle repair tool comprising a handle configured for gripping engagement by the bicyclist. The handle has a first end and an opposite second end, and left and right side walls connected by a planar bridge. A plurality of repair tools are pivotably mounted to the first end of the handle between the left and right side walls. Preferably, the plurality of tools includes standard hex wrenches useful for repairing bicycle components.

In one feature of the invention, the combination repair tool includes a chain tool removably supported within the tool handle. The chain tool can be of a conventional design including a chain tool handle, a threaded collar, a chain support integrally disposed at one end of the chain tool handle and a pressure screw threadedly engaged through the collar. In one embodiment, the pressure screw includes an internal hex head sized to be driven by one of the hex wrench repair tools.

The inventive repair tool contemplates slidably supporting the chain tool so that it can be easily removed from the tool handle for use. In one embodiment, the left side wall defines a slot at the second end of the handle that is sized and arranged to slidably receive the threaded collar of the chain tool. Thus, the chain tool can be slid into the repair tool handle with the chain tool handle in contact with the planar bridge.

In a further feature, the chain tool handle defines an opening therethrough. The planar bridge of the tool handle also defines a raised boss that is sized to be received within the opening when the chain tool handle is in contact with the planar bridge. The boss and opening combine to resist accidental dislodgment of the chain tool from the repair tool handle. In a specific embodiment, the raised boss is elongated, having a first end adjacent the first end of the handle and a second end adjacent the second end of the handle, and further defines a sloped surface at the first end thereof. The sloped surface facilitates sliding the chain tool over the raised boss when it is desired to use the chain tool.

In certain features of the invention, the chain tool, and a particularly its handle, is configured for a friction-fit engagement with the repair tool handle. Thus, in one aspect, the chain tool includes a support flange and a support boss at opposite ends of the threaded collar. The tool handle can further define an indented slot coincident with the slot defined in the left side wall. While the support flange is sized to be slidably received within the indented slot, the support boss and the support flange cooperate to form a loose friction-fit engagement with the left side wall at the slot.

The chain tool handle can further include a friction-fit surface at the one end of the chain tool handle opposite the threaded collar. The right side wall of the repair tool handle can define a mating recess sized to slidably receive the friction-fit surface of the chain tool handle therein when the threaded collar is disposed within the slot in the left side wall. To further enhance the dislodgment resistance of the tool, the left side wall can further define a ridge within the slot, the ridge bearing against the threaded collar when the collar is disposed within the slot.

In yet another aspect of the inventive combination repair tool, the planar bridge includes a first surface against which the plurality of repair tools rest in a folded position. The bridge further includes a relief step down to a second surface offset from the first surface. This relief step is adjacent the free end of the plurality of repair tools to permit finger access to the free end.

It is one object of the invention to provide a combination bicycle repair tool that includes a chain tool. A further central object is to make the chain tool readily accessible and usable for making field chain repairs.

One benefit of the invention is that the chain tool can be removed from the combination repair tool to facilitate its use. A further benefit is that the combination tool retains a compact envelope, even with the chain repair tool mounted in its stowed position.

Other objects and benefits of the invention will become apparent upon consideration of the following written description together with the accompanying figures.

DESCRIPTION OF THE PREFERRED EMBODIMENT

Figure 1:
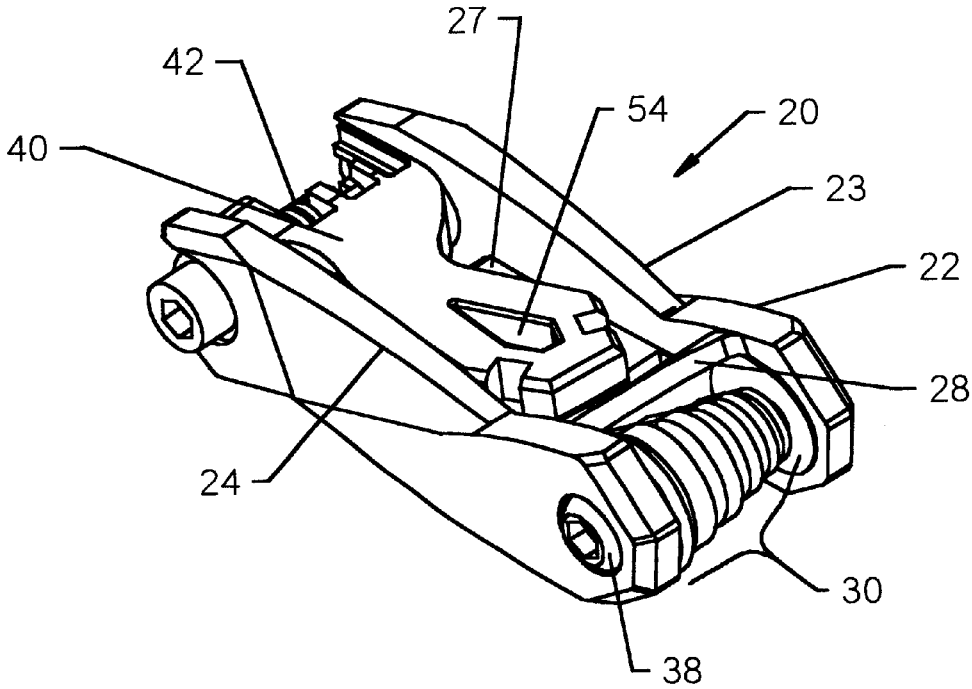
FIG. 1 is a top perspective view of a bicycle repair tool in accordance with one embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended. The inventions includes any alterations and further modifications in the illustrated devices and described methods and further applications of the principles of the invention which would normally occur to one skilled in the art to which the invention relates.

Figure 2:
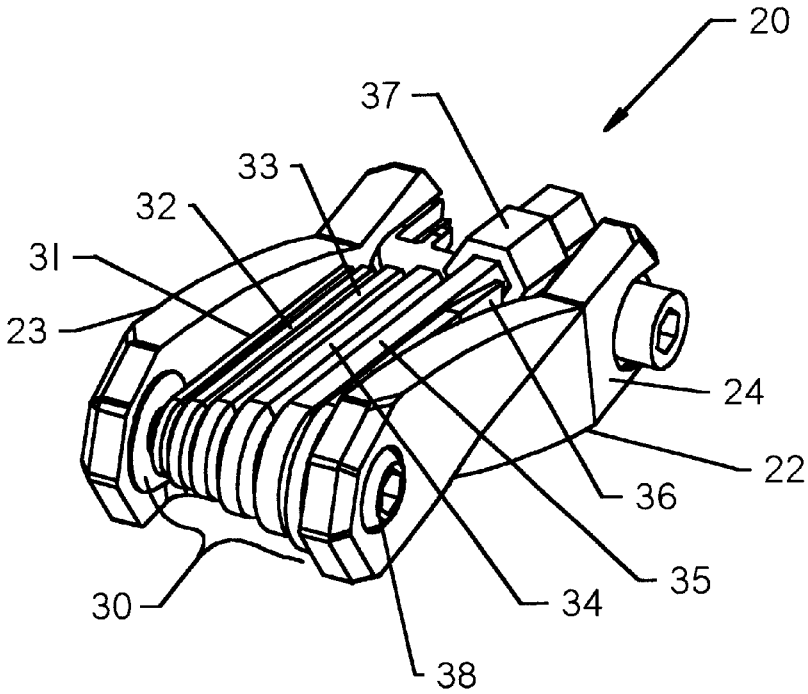
FIG. 2 is a bottom perspective view of the bicycle repair tool shown in FIG. 1.
Figure 3:
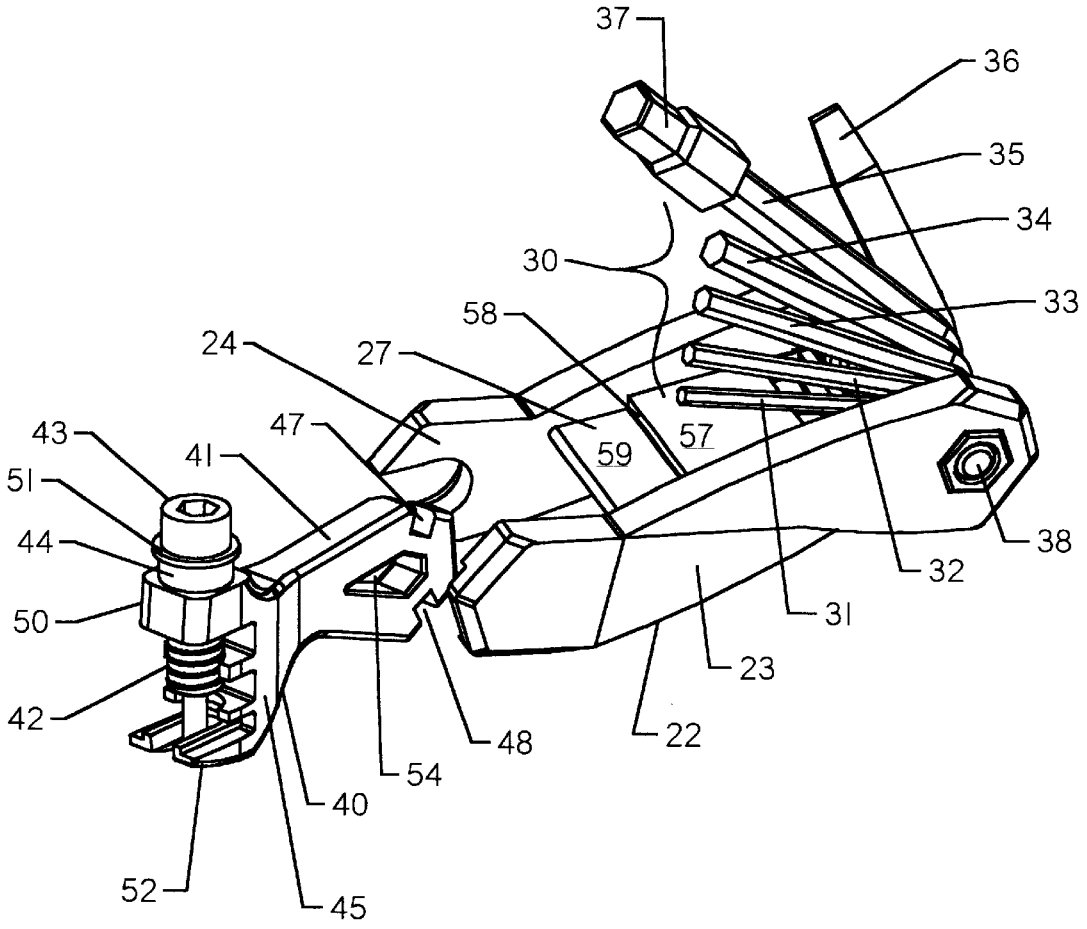
FIG. 3 is a bottom perspective of the bicycle repair tool shown in FIGS. 1 and 2, with the chain tool removed.

The present invention contemplates a bicycle repair tool 20 as depicted in FIGS. 1–3. The tool 20 includes a handle 22 that is sized to be easily gripped by the bicyclist. The outer surfaces of the handle can be contoured to provide a comfortable and efficient gripping surface to allow the bicyclist to exert significant force when using the tool. Preferably, the handle is formed of a tough, yet lightweight, plastic. Also preferably the handle 22 is formed as single piece, although the present invention can be accomplished readily with a multi-piece handle.

Figure 7:
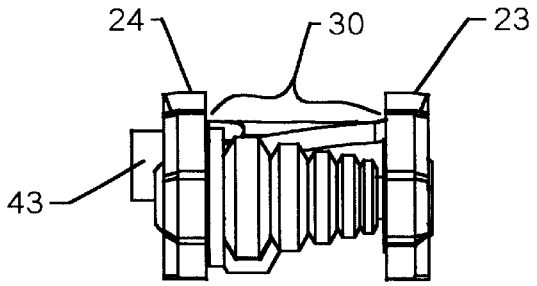
FIG. 7 is an end elevational view of the tool shown in FIG. 6.

The handle 22 includes a first side wall 23 and an opposite side wall 24. The two side walls are connected by way of a center bridge 27 that is generally planer in configuration. An end bridge 28 it is provided at one end of the first and second side walls. The end bridge is arranged to shield an array of folding tools 30 pivotably mounted between the first and second side walls 23 and 24 as depicted in FIG. 7. The end bridge 28 provides additional rigidity and torsional strength to the handle 22 at the end with the primary working tools 30.

The folding tools 30 can include a variety of bicycle repair tools. In the preferred embodiment, the array of folding tools 30 includes a range of hex wrenches 31–35, preferably sized, but not limited to, at 2.5, 3.0, 4.0, 5.0 and 6.0 millimeters respectively. In addition, a flat blade or Phillips screwdriver 36 can be included among the tools 30 as depicted in FIG. 3. As a further feature, the 6.0 millimeter folding tool 35 can carry an 8.0 millimeter key 37 removably mounted thereon. The key 37 can alternatively be provided with an internal hex for engaging an external hex head bolt.

The folding tools 30 are rotably engaged to the handle 22 by way of a pivot bolt 38 passing through a bolt opening 73 (see FIGS. 6, 9 and 10) defined in each of the side walls 23 and 24. As shown best in FIG. 5, the folding tools preferably are formed from bar stock that is bent to form a circular opening 39 through which the pivot bolt 38 passes. The folding tools 30 are most typically formed of a metal, such as stainless steel.

Figure 5:
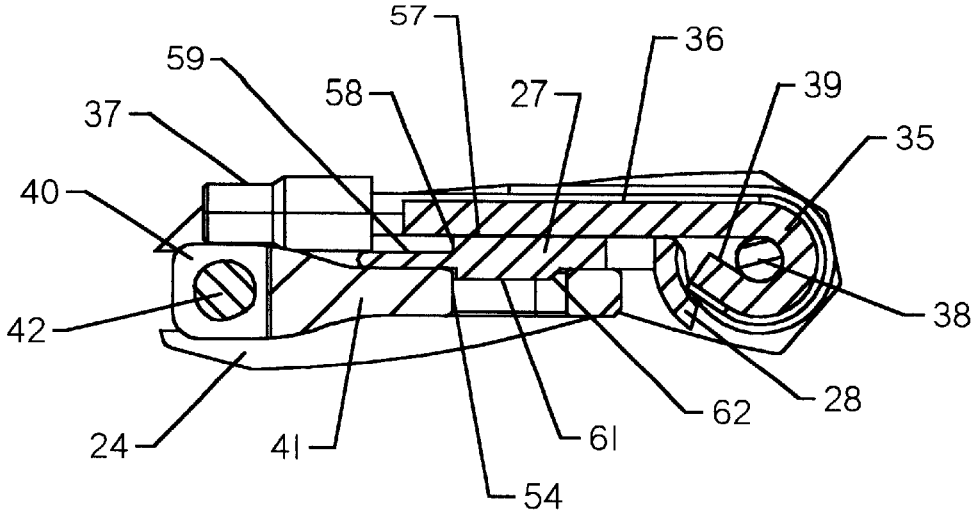
FIG. 5 is a side cross-sectional view of the tool shown in FIG. 4, taken along line 5—5 as viewed in the direction of the arrows.
Figure 6:
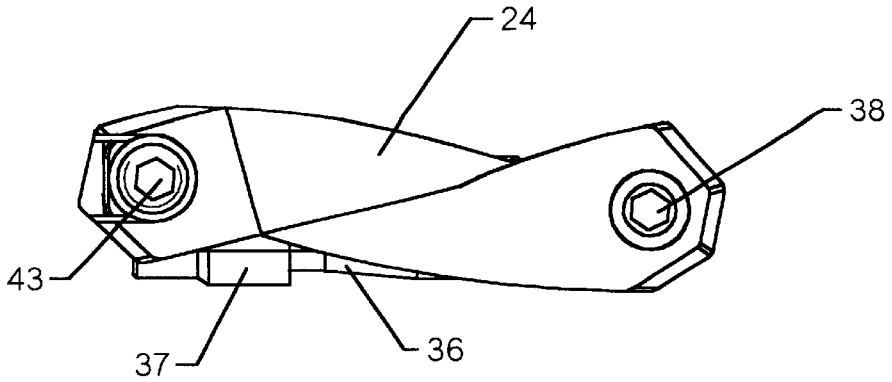
FIG. 6 is a side elevational view of the tool shown in FIG. 4.
Figure 9:
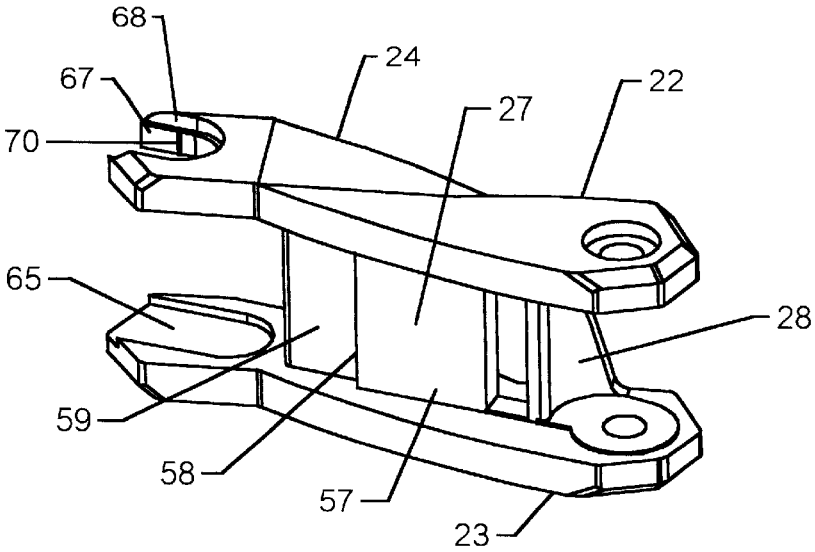
FIG. 9 is a bottom perceptive view of the one-piece handle component of the bicycle repair tool shown in previous figures.
Figure 10:
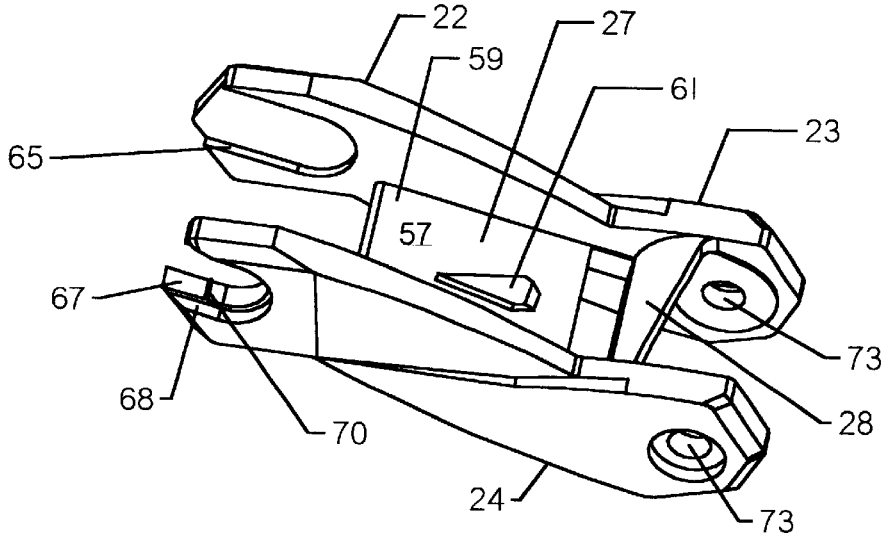
FIG. 10 is a top perspective view of the one-piece handle component shown in FIG. 9.

Shown best in FIGS. 3 and 5, and in the detailed views of the handle 22 in FIGS. 9 and 10, the center bridge 27 includes a first support platform 57 against which the various folding tools 30 rest in their undeployed position. In addition, the center bridge 27 follows a relief step 58 to a second support platform 59. Preferably, the step is of sufficient depth so that the 8.0 millimeter hex key 37 can rest directly on the second support platform 59 while the associated 6.0 millimeter hex wrench 35 contacts the first support platform 57.

In addition, the relief step 58, and consequently, the gap between the first support platform 57 and the second support platform 59, provides a relief area for the bicyclist to use his/her finger to pry one of the folding tools 31–36 upward and away from the center bridge 27 into its deployed position. With this configuration, the center bridge 27 provides adequate stiffness and support to the handle 22 so that the entire tool 20 can be used to apply a force to one of the deployed tools 31–36 without excessive flexing of the tool. At the same time, the center bridge 27 allows ready access to the free ends of the folding tools 30 so that they can be easily pivoted into their useable positions.

Looking again at FIG. 9, it can be seen that the end bridge 28 is arranged at the location of the folding tools 30. Preferably, the end bridge 28 exhibits a curvature that essentially follows the curvature of the curved ends 39 of the folding tools 30.

Figure 8:
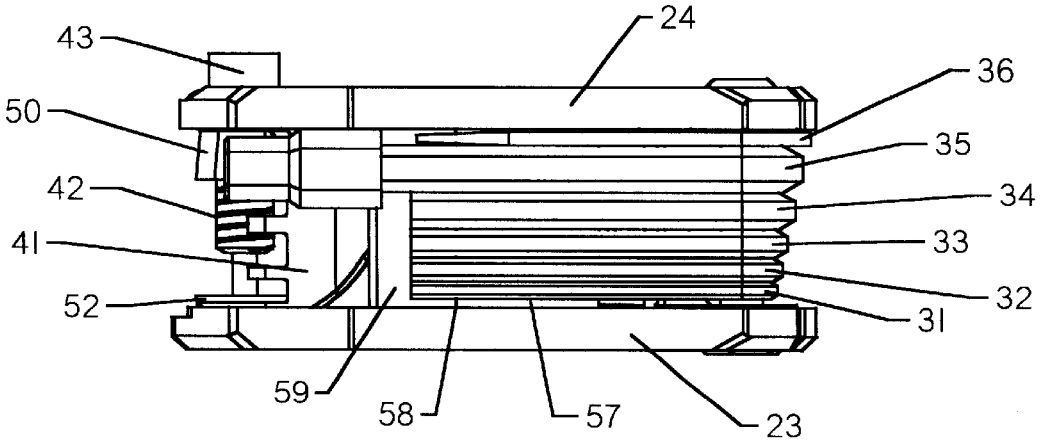
FIG. 8 is a bottom elevational view of the tool shown in FIG. 4.

Referring to back FIG. 1, the bicycle repair tool 20 also includes a chain tool 40 that is removably mounted within the handle 22. As shown in more detail in FIGS. 3 and 8, the chain tool includes a handle 41 and a pressure screw 42. The pressure screw 42 extends through a thread collar 43 integral with the handle 41. In the preferred embodiment, the pressure screw 42 includes an internal hex head 43. The internal hex of the head 43 is configured to be engaged by one of the folding tools 30, preferably the 5.0 millimeter hex wrench 34. Thus, the repair tool 20 utilizes one of the folding tools to provide one of the rotational movements to the pressure screw 42 that is required to displace and remove the rivet from a chain link.

The chain tool 40 further includes a chain support 45, again integrally formed with the handle 41. The chain support 45 can be of a variety of known configurations for stably supporting the chain link while the pressure screw 42 is used to dislodge the rivet. In an additional feature, the handle 41 of the chain tool is configured at a free end to define multiple spoke wrench recesses, such as recesses 47 and 48. Thus, the chain tool 40 can also be used to tighten or loosen the wheel spokes.

As can be seen in FIG. 3, the chain tool 40 can be entirely removed from the handle 22 so that the tool can be easily manipulated by the bicyclist. Due to its small size, the chain tool 40 can be easily used on the road to replace a chain link while the chain is still mounted on the bicycle.

As an important adjunct to the ready availability of the chain tool 40, the handle 22 and chain tool incorporate features that allow the tool to be firmly seated within the tool handle 22 until it is needed. Specifically, the handle 22 defines a friction-fit recess 65 at the interior of the first side wall 23. The opposite second side wall 24 defines a slot 67. This slot is sized to receive the threaded collar 44 of the chain tool 40 therein. A support boss 50 and a support flange 51 flank the threaded collar 44. The support boss 50 engages the inner surface of the second side wall 24. The support flange 51 has a larger diameter than the threaded collar 44. Consequently, the slot 67 in the second side wall 24 defines an additional indented slot 68 that is sized to accept the support flange 51.

In the preferred embodiment, the handle 41 of the chain tool further includes a friction-fit surface 52 opposite the support boss 50. The chain tool handle 41 is sized so that the support boss 50 and friction-fit surface 52 form a slight friction-fit engagement between the second side wall 24 and the friction-fit recess 65 of the first side wall 23. In addition, the distance between the support boss 50 and the support flange 51 is sized to form a slight friction-fit engagement within the slot 67 and indented slot 68. To further enhance the support, the slot 67 can define at least one ridge 70 that presses against the threaded collar 44 when the collar is within the slot 67.

Figure 4:
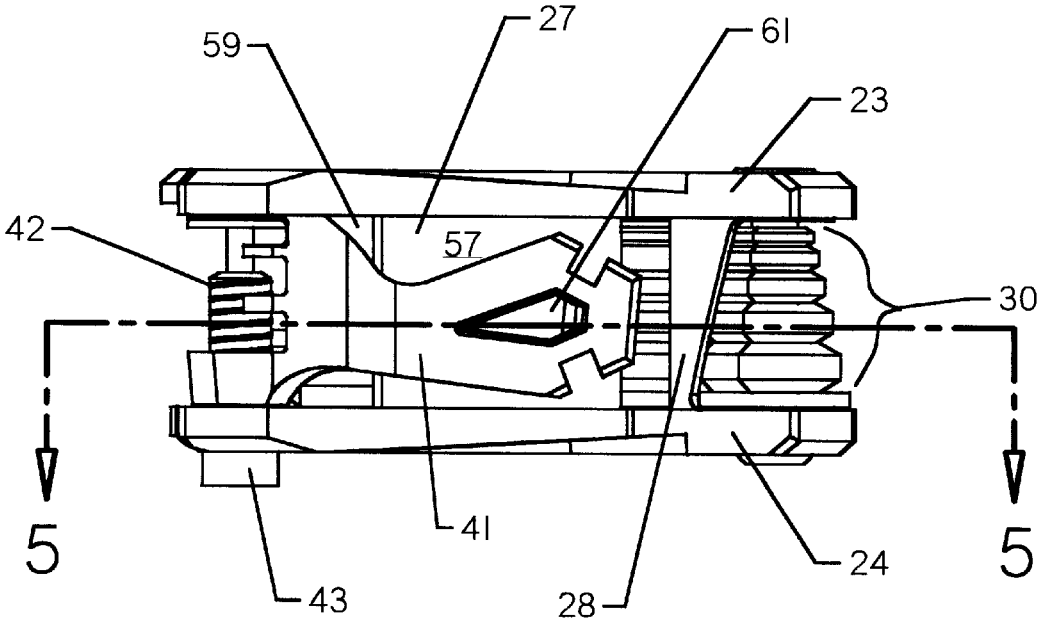
FIG. 4 is a top elevational view of the bicycle repair tool shown in FIGS. 1–3.
Figure 11:
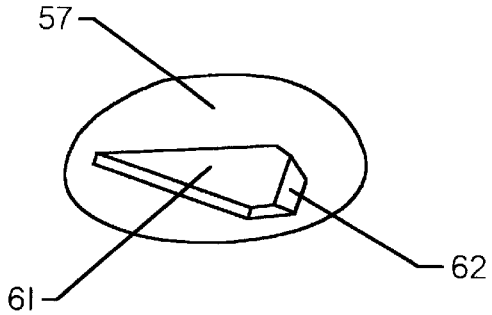
FIG. 11 is an enlarged view of the retaining boss formed on the center bridge of the handle depicted in FIG. 5.

In the most preferred embodiment as shown in FIGS. 3–4, the handle 41 of the chain tool 40 defines a retention opening 54 adjacent to the free end. This retention opening 64 is sized to form a loose fit engagement with a retention boss 61 defined on the center bridge 27. Most preferably, the boss 61 (see FIG. 11) and the opening 54 (see FIG. 3) have a non-uniform, or non-circular configuration to prevent accidental dislodgment of the chain tool 40 from the handle 22.

In one specific embodiment, the chain tool 40 can be removed by first pivoting the tool relative to the press fit recess 65 and slot 67. As the tool is pivoted, it becomes dislodged from the boss 61. At that point, the tool can be pulled axially out of the recess 65 and slot 67 so that the chain tool 40 is available for use. In a most preferred embodiment, the boss 61 defines a sloped surface 62 at one end of the boss. The chain tool 40 can be removed by simply sliding the handle 41 up the sloped surface 62, dislodging the tool from the recess 65 and slot 67.

The retention boss 61 can have a height of about 1.0 mm. The sloped surface 62 can then slope from this 1.0 mm. height to the surface of the center bridge 27.

Preferably, the chain tool 40 is formed of metal, such as chrome-molybdenum or stainless steel. Likewise, the pressure screw 42 is of metal construction.

While the invention has been illustrated and described in detail in the drawings and foregoing description, the same is to be considered as illustrative and not restrictive in character. It should be understood that only the preferred embodiments have been shown and described and that all changes and modifications that come within the spirit of the invention are desired to be protected.

What is claimed is:

1. A combination bicycle repair tool comprising:

a handle configured for gripping engagement by a bicyclist, said handle having a first end and an opposite second end, and said handle being defined by a left and right side walls connected by a planar bridge;

a plurality of repair tools;

mounting means for pivotably mounting said plurality of repair tools to said first end of said handle between said left and right side walls;

a chain tool including a chain tool handle, a threaded collar and a chain support integrally disposed at one end of said chain tool handle and a pressure screw threadedly engaged through said collar; and a slot defined in said left side wall at said second end of said handle, said slot sized and arranged to slidably receive said threaded collar of said chain tool therein with said chain tool handle in contact with said planar bridge.

2. The bicycle repair tool according to claim 1, wherein:

a number of said plurality of repair tools includes a hex wrench; and said pressure screw includes a head having an internal recess sized to receive said hex wrench therein.

3. The bicycle repair tool according to claim 1, wherein:

said chain tool handle defines an opening therethrough; and said planar bridge of said handle defines a raised boss sized to be received within said opening when said chain tool handle is in contact with said planar bridge.

4. The bicycle repair tool according to claim 3, wherein said raised boss is elongated, having a first end adjacent said first end of said handle and a second end adjacent said second end of said handle, said raised boss further defining a sloped surface at said first end thereof.

5. The bicycle repair tool according to claim 1, wherein:

said chain tool includes a support flange and a support boss at opposite ends of said threaded collar; and said handle further defining an indented slot coincident with said slot defined in said left side wall, wherein said support flange is sized to be slidably received within said indented slot, and said support boss and said support flange cooperate to form a friction-fit engagement with said left side wall at said slot.

6. The bicycle repair tool according to claim 1, wherein:

said chain tool handle includes a friction-fit surface at said one end of said chain tool handle opposite said threaded collar; and said right side wall of said handle defines a friction-fit recess sized to slidably receive said friction-fit surface of said chain tool handle therein when said threaded collar is disposed within said slot in said left side wall.

7. The bicycle repair tool according to claim 1, wherein said left side wall further defines a ridge within said slot, said ridge bearing against said threaded collar when said collar is disposed within said slot.

8. The bicycle repair tool according to claim 1, wherein:

said plurality of repair tools each include a free end opposite said mounting means; and said planar bridge includes;

a first surface against which said plurality of repair tools rest in a folded position;

a relief step; and a second surface at said relief step and offset from said first surface adjacent said free end of said plurality of repair tools to permit finger access to said free end.

9. The bicycle repair tool according to claim 1, wherein:

said left and right side walls have a width;

said planar bridge is generally centrally located within said width of said side walls, wherein when said chain tool handle is in contact with said planar bridge it falls within an envelope defined by said planar bridge and said left and right side walls.

* * * * *